US005842641A

United States Patent [19]

Mazzalveri

[11] Patent Number: 5,842,641

[45] Date of Patent: Dec. 1, 1998

[54] DEVICE FOR MOISTENING FLUID-DISPENSING NOZZLES OF A DISPENSING MACHINE

[75] Inventor: Leopoldo Mazzalveri, Bologna, Italy

[73] Assignee: Corob S.p.A., Modena, Italy

[21] Appl. No.: 805,056

[22] Filed: Feb. 24, 1997

[30] Foreign Application Priority Data

Mar. 27, 1996 [IT] Italy ..... MI96A0601

[51] Int. Cl.[6] ..... B05B 15/04

[52] U.S. Cl. ..... 239/104

[58] Field of Search ..... 239/104, 112

[56] References Cited

FOREIGN PATENT DOCUMENTS 6-226147 8/1994 Japan ..... 239/104

*Primary Examiner*—Lesley D. Morris

*Attorney, Agent, or Firm*—Sughrue, Mion, Zinn, Macpeak & Seas, PLLC

[57] ABSTRACT

A device for moistening a set of nozzles for dispensing fluids in a dispensing machine has a support for the nozzles and a hollow member movable selectively along a predetermined path from a first position in which the set of nozzles is covered to a second position in which the nozzles are uncovered; in the position in which the set of nozzles is covered, the hollow member cooperates with a sealing element to define a first closed chamber; an isolation element movable selectively relative to the hollow member cooperates with the nozzle support to define at least one second closed chamber which is disposed inside the first closed chamber and in which at least one nozzle of the dispensing machine emerges.

14 Claims, 4 Drawing Sheets

DEVICE FOR MOISTENING FLUID-DISPENSING NOZZLES OF A DISPENSING MACHINE

DESCRIPTION

The present invention relates to a device for moistening fluid-dispensing nozzles of a dispensing machine, of the type comprising means for supporting the nozzles and a hollow member movable along a predetermined path from a first position in which a set of nozzles is covered to a second, uncovering position.

A moistening device of the type indicated above which is particularly suitable for use on a dye dispensing machine is the subject of the Applicant's Italian patent application BO95A000591.

In the following description, the term "moistening" will mean, in general terms, the ability to maintain a high degree of vapor saturation of the air contained in a closed space into which the dispensing ends of the nozzles emerge. In the simplest case, the vapor, of which a high degree of saturation is to be maintained, is water vapor but, naturally, the invention may also be used when it is necessary or preferable to use vapors of other kinds on account of the physical/chemical characteristics of the fluids which can be dispensed by the dispensing machine.

An object of the invention is to produce a closed space of small dimensions when the moistening device is in the covering position so as to reduce the quantity of vapor required to saturate the air contained therein.

A further object of the invention is to provide a reliable, low-cost device which is easy and cheap to produce and which requires little or almost no maintenance.

In order to achieve the objects indicated above, the subject of the present invention is a moistening device of the type indicated in the introduction to the present description, characterized in that it comprises an isolation element coupled to the hollow member and movable relative thereto from a retracted position, in which the isolation element is at least partially housed in the cavity of the hollow member, to an extracted position in which the isolation element cooperates with the support means of the nozzles to define a closed space.

Another object of the invention is to provide a device the operation of which is reliable and accurate and can easily be automated.

This object is achieved by a further characteristic of the moistening device which comprises means for actuating the movement of the isolation element and means for controlling the actuating means in order to bring about the selective movement of the isolation element in dependence upon the position adopted by the hollow member in its movement along the predetermined path.

Figure 1:
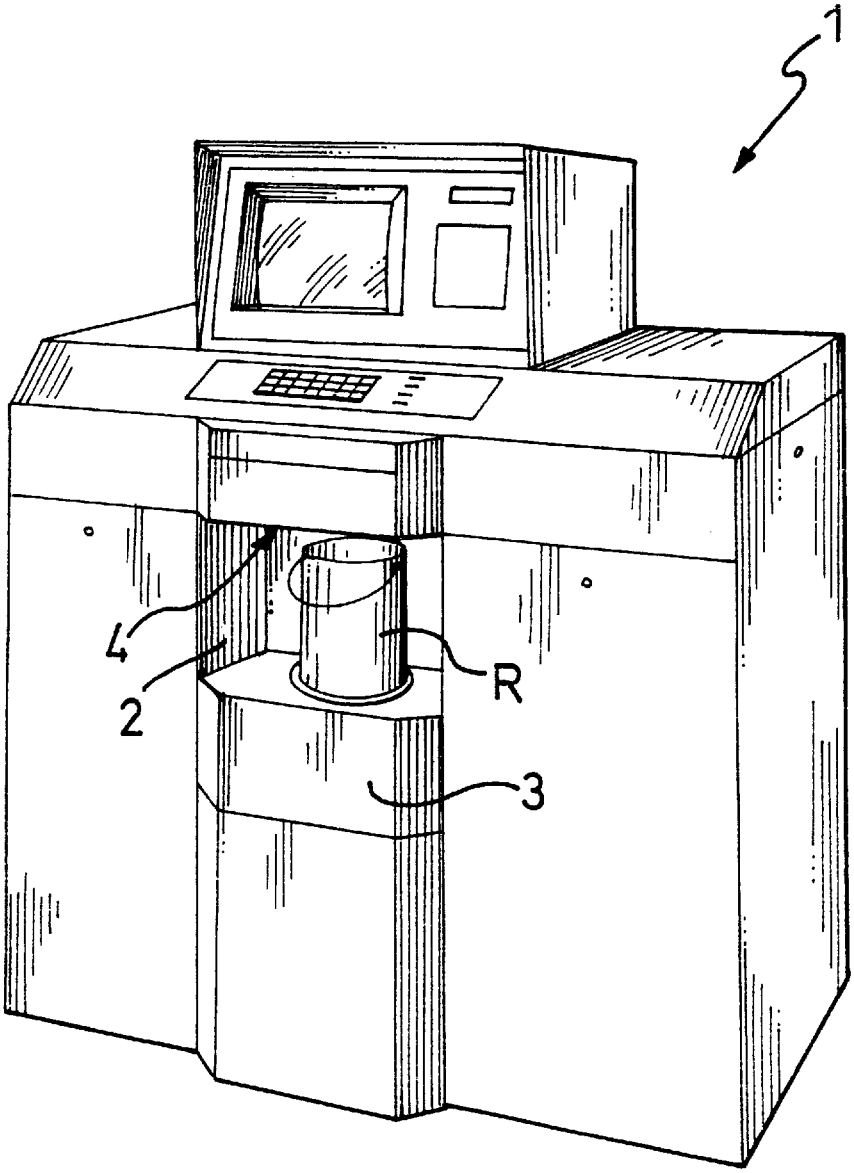
Figure 2:
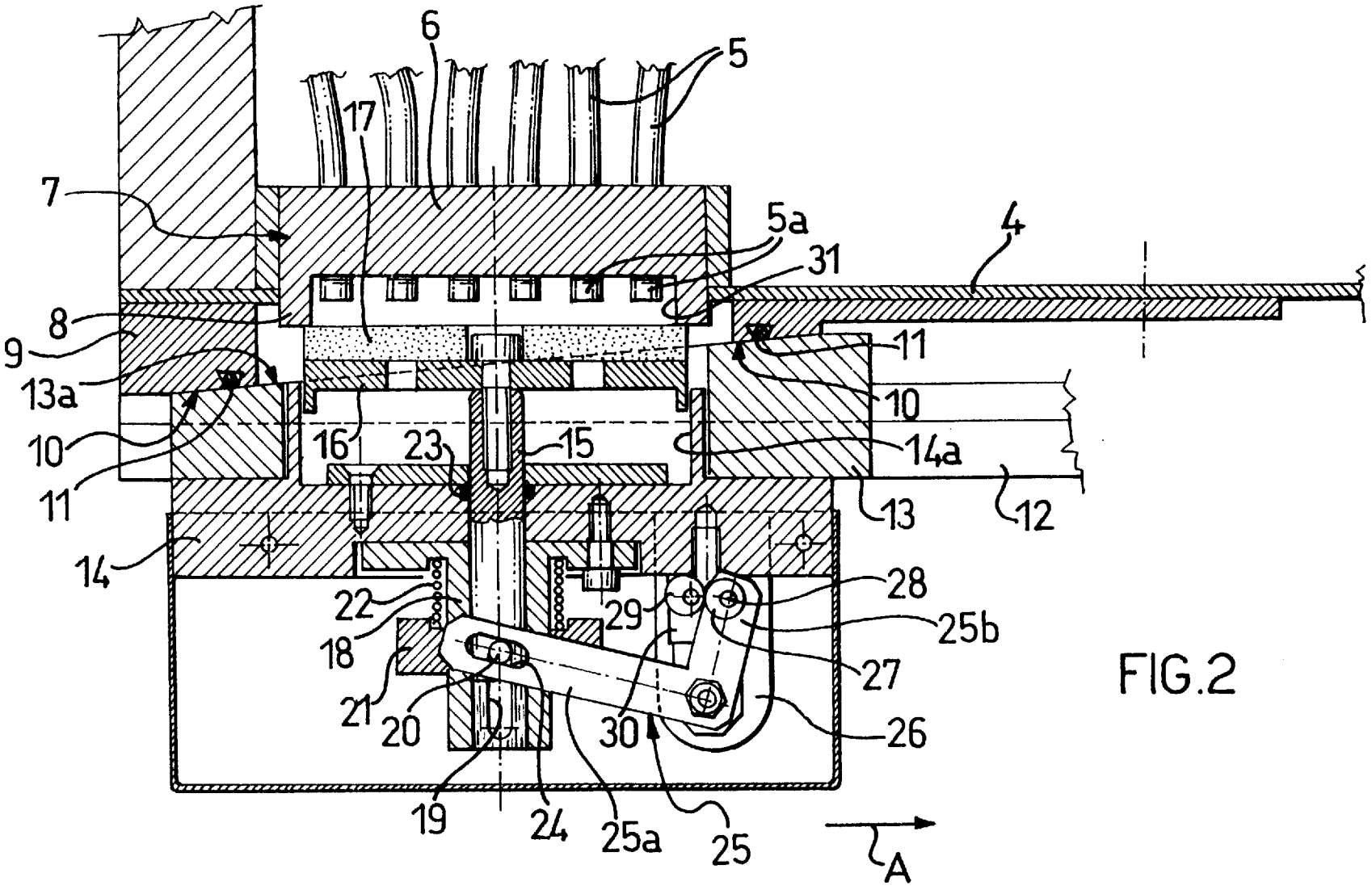
Figure 3:
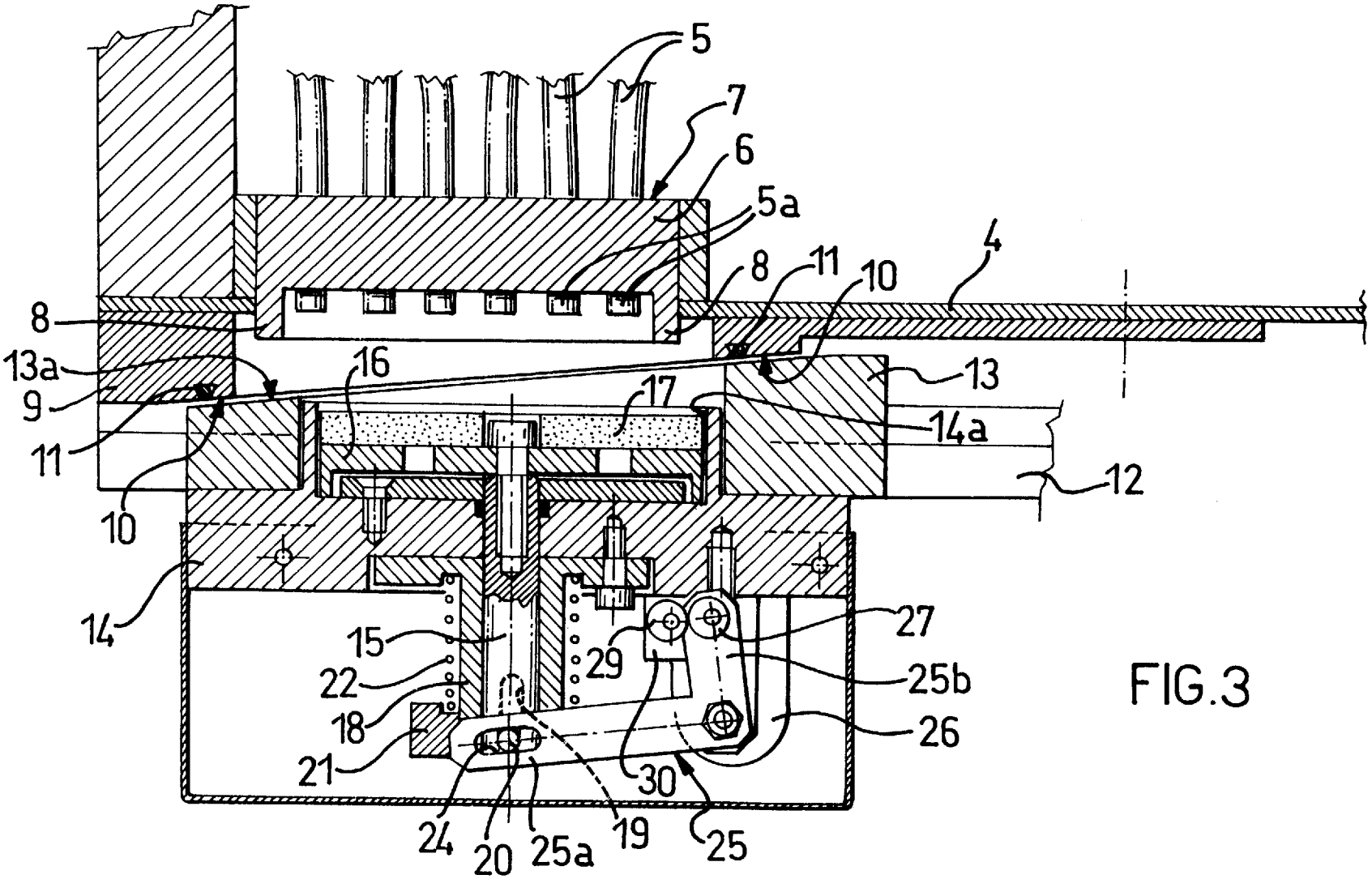
Figure 4:
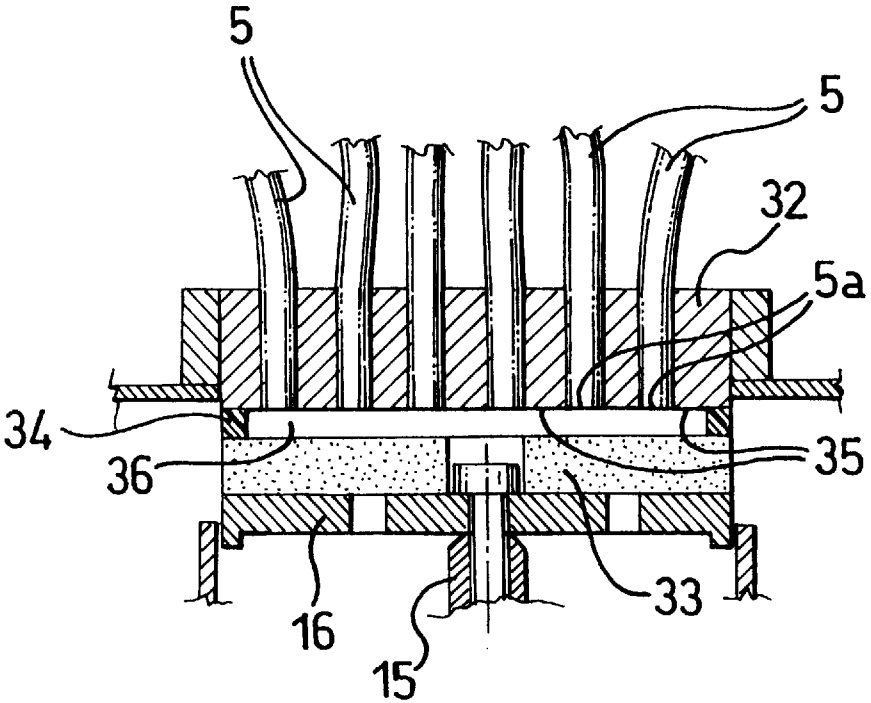

Further characteristics and advantages of the invention will become clear from the following detailed description of a preferred embodiment, given purely by way of non-limiting example with reference to the appended drawings, in which:

FIG. 1 is a perspective view of a dispensing machine,

FIG. 2 is a side view of a moistening device mounted on the dispensing machine of FIG. 1, shown in a position in which the dispensing nozzles are isolated, most of the device being shown in longitudinal section for greater clarity, FIG. 3 is a side view similar to that of FIG. 2, in which the moistening device is shown in a position in which the nozzles are partially uncovered, and FIG. 4 is a sectioned view of a variant of a detail of the device of the present invention.

With reference now to the drawings, an automatic dispensing machine 1 comprises a space 2 defined at the bottom by a shelf 3 for the positioning of a container R, into which predefined quantities of fluid products, particularly dyes, bases, inks, pigments and the like are to be dispensed. Although an automatic dispensing machine is referred to herein, the invention may also be used on semi-automatic or manual machines. The invention is applicable, in general, to any dispensing machine of known type, regardless of its configuration and its specific dimensions.

The upper portion of the space 2 is closed by a horizontal plate 4 (see FIGS. 2 and 3) from which the ends 5*a* of dispensing pipes 5 project, the pipes extending through the base 6 of a nozzle-center body 7 which preferably, but in non-limiting manner, is shaped as an inverted cup. In the embodiment shown in the drawings, the ends 5*a* constitute the dispensing nozzles of the dispensing machine but, naturally, the manner in which these nozzles are formed may vary widely according to the characteristics of the dispensing machine on which they are mounted and they may thus adopt any form known to experts in the art.

In the embodiment shown in FIGS. 2 and 3, the height of a peripheral wall 8 of the nozzle center-body 7 is a little greater than the distance by which nozzles 5*a* project from the base 6. Naturally, if the ends 5*a* of the dispensing pipes 5 did not in fact project from the base 6, the height of the peripheral wall 8 could be reduced to a minimum or it may not even be present.

Moreover, in an alternative embodiment of the present invention, as described further below and illustrated in FIG. 4, the peripheral wall 8 may also be entirely missing.

Fixed to the lower portion of the plate 4 is an annular body 9, the lower wall 10 of which is inclined to the horizontal and has a recess in which an annular seal 11 is mounted. A slide 13, the upper wall of which 13*a* is inclined to the horizontal to the same extent as the wall 10 of the annular body 9, is mounted for sliding on guides 12 parallel to the plate 4. The slide 13 is moved by means of a linear actuator (not shown in the drawings) or by means of any other movement device of known type. In the simplest cases, the slide may even be moved manually.

Engagement devices may also be provided for locking the slide in the position in which the nozzles are covered and/or in the position in which they are uncovered.

Finally, the movement of the slide may be assisted or opposed by the provision of resilient reaction means, in a known configuration.

The slide 13 supports a dish-like body 14 comprising a cavity 14*a*, the base of which has a hole through which a rod 15 can extend to drive a perforated plate 16 to which a disc 17, preferably of absorbent material such as felt, sponge, natural or synthetic fibers or the like, is fixed in turn. A seal 23 allows the rod 15 to slide in a leaktight manner. As mentioned above, in an alternative embodiment of the present invention, as shown in FIG. 4, if the ends 5*a* of the dispensing pipes 5 do not in fact project from the body, which is indicated 32 in this embodiment, the absorbent element, indicated 33, may be cup-shaped and its upper edge, indicated 34, may be made of resilient or flexible material so as to form a ring for sealing the closed chamber, indicated 36, against the base 35 of the body 32. Moreover, this upper edge may not be made of resilient or flexible material.

Alternatively, when the nozzle-center body has no peripheral walls, it is possible to form in the upper surface of the absorbent element notches, recesses, or generic shapings to be located in the region of the nozzles so as to form a plurality of small chambers when the absorbent element is in contact with the nozzle-center body 7.

A tube 18 for guiding the rod 15 is fixed below the dish-like body 14 in the region of the central hole. Two diametrally-opposed vertical slots 19 are formed in the side walls of the tube 18 and a transverse pin 20 inserted therein extends through a corresponding transverse hole in the rod 15 and projects from both sides of the tube 18.

An annular plate 21 mounted for sliding on the tube 18 has transverse holes through which the pin 20 can extend, the pin 20 thus being fixed to the rod 15 and to the plate 21 and being movable vertically relative to the tube 18 within the range defined by the extent of the slots 19.

A helical spring 22 is interposed between the base of the dish-like body 14 and the annular plate 21.

The ends of the transverse pin 20 are inserted in two further slots 24 disposed at the ends 25*a* of two L-shaped levers 25 (only one of which is shown in FIGS. 2 and 3) which are articulated in their central regions to an appendage 26 projecting downwards from the dish-like body 14. A transverse bar 27 with a circular cross-section is mounted on the levers 25 so as to join their two ends 25*b* opposite the ends 25*a* with the slots 24. The axis of the bar 27 is preferably arranged eccentrically relative to the point 28 at which the bar is fixed to the levers.

A check block 29 is mounted on an appendage 30 disposed in a predetermined fixed position relative to the guides 12 and hence to the plate 4 and to the nozzles 5*a*.

Preferably, the check block 29 has a circular cross-section and is mounted so that its horizontal axis is eccentric relative to the point at which it is fixed to the appendage 30.

In use, the cavity 14*a* of the dish-like body 14 is filled with a moistening liquid such as water. When required by the particular nature of the dyes or of the fluids which can be dispensed through the nozzles 5*a*, the liquid held in the cavity 14*a* may be a known solvent other than water.

In the covering position shown in FIG. 2, the absorbent disc 17, impregnated with moistening liquid as described further below, closes the opening of the nozzle-center body 7 so as to define a closed chamber 31 in which the nozzles 5*a* are disposed. The volume of air imprisoned inside the closed chamber 31 is quickly saturated by the vapors of the liquid with which the absorbent disc 17 is impregnated, thus preventing the fluid in the nozzles 5*a* from drying. Moreover, the fact that the upper surface of the disc 17 is spaced, albeit slightly, from the nozzles 5*a* prevents any residues or drops of fluid coming out of one of the nozzles 5*a* and spreading out by capillarity on the absorbent disc 17 from reaching one or more of the other nozzles and being mixed with the fluid therein, contaminating it. A similar result can be achieved by means of the small chambers described above.

In the position illustrated in FIG. 2, the absorbent disc 17 is kept pressed against the opening of the nozzle-center body 7 by virtue of the thrust exerted by the perforated plate 16 and by the rod 15 by means of the pin 20 which is held in the position shown by the L-shaped levers 25. The position of the slide 13 is in fact such that the bar 27 is in abutment with the block 29 and keeps the levers 25 pivoted, in opposition to the resilient force exerted by the spring 22. The pressure of the absorbent disc 17 on the opening of the nozzle-center body 7 can be regulated by adjustment of the eccentric positions of the bar 28 and of the block 29 so as to take up any play due to the continued use over a period of time of the same absorbent disc 17 which, by its nature, tends to become squashed and in which an ever more marked annular imprint is progressively formed.

In this covering position, moreover, the inclined walls 10 and 13*a* of the annular body 9 and of the slide 13, respectively, are in contact with one another so that the seal 11 constitutes a barrier which prevents evaporation of the liquid held in the cavity 14*a* and of that absorbed by the disc 17.

When fluids are to be dispensed into the container R, the slide 13 is moved, automatically or manually, in the direction of the arrow A of FIG. 2 so as to move apart the surfaces 10, 13*a* of the annular body 9 and of the slide 13, respectively. The movement of the slide 13 allows the levers 25 to pivot anticlockwise under the thrust exerted by the spring 22 which presses against the plate 21 which entrains the pin 20 downwards. The rod 15 is thus urged downwards, entraining with it the perforated plate 16 and the absorbent disc 17. The perforated plate 16 is plunged into the cavity 14*a* and the liquid therein can impregnate the absorbent disc 17, passing through the holes in the perforated plate 16.

When the slide 13 has reached the position shown in FIG. 3, the pin 20 has reached the lower ends of the slots 19. In this position, the slide 13 can be retracted further without the absorbent disc 17 interfering with the annular body 9 fixed to the plate 4.

A movement of the slide 13 in the opposite direction to that of the arrow A from the uncovering position of the moistening device returns the device to the covering position shown in FIG. 2.

Finally, the covering of the nozzles 5*a* and the simultaneous creation of the closed chamber 31 with a small volume are brought about by the movement of the slide 13 alone, without the functionality and the practicality of use of the dispensing machine being reduced or the purity of the fluids which can be dispensed through the nozzles being compromised thereby.

Many variations may be applied to the device shown in the drawings and described above, without thereby departing from the basic principles of the invention.

Purely by way of example, the spring 22 could be replaced by any resilient element of known type and could also be eliminated with the provision, in its place, of a spring acting directly on the levers 25, for example, a torsion spring wound around the articulation axis of the levers on the appendage 26. The number, arrangement and configuration of the levers 25 and of all of the members for transmitting the movement to the perforated plate 16 in general may also be modified on the basis of normal design criteria within the capability of any expert in the art. The actuator means which drive the absorbent element may be hydraulic, pneumatic, electromechanical, etc., and may even be manual.

Similar considerations apply with regard to the size, shape and materials of the absorbent disc or element 17 and to its dimensions relative to the size of the opening of the nozzle-center body 7. For example, the diameter of the absorbent disc 17 could be larger than that of the opening, or could substantially correspond thereto, so that it could be fitted inside the opening with minimal interference.

A variant of the device of the present invention provides for the elimination of the moistening liquid or solvent and possibly of the perforated plate 16 and for the replacement of the absorbent disc 17 with a hermetic, rigid, resilient or generally flexible plug.

Finally, an important characteristic of the device according to the present invention is the presence of a double seal;

the first seal 11 isolates the dish-like body 14 from the outside atmosphere to prevent evaporation of the liquid in the cavity 14*a* or of the liquid absorbed by the disc 17 through the perforated plate 16, whilst the second seal is formed by the abutment of the disc 17 against the nozzle-center body 7 in order to maintain the saturation of the volume of air, even though it is small, in the chamber in which the ends 5*a* of the nozzles 5 emerge.

Naturally, the principle of the invention remaining the same, the forms of embodiment and details of construction may be varied widely with respect to those described and illustrated, without thereby departing from the scope of the present invention.

I claim:

1. A device for moistening a set of nozzles for dispensing fluids from a dispensing machine, comprising:

means for supporting the nozzles, and a hollow member movable selectively along a predetermined path from a first position in which the set of nozzles is covered to a second position in which the nozzles are uncovered, characterized in that, in the position in which the set of nozzles is covered, the hollow member cooperates with sealing means to define a first closed chamber, an isolation element movable selectively relative to the hollow member cooperating with the nozzle-support means to define at least one second closed chamber which is disposed inside the first closed chamber and in which at least one nozzle of the dispensing machine emerges.

2. A device according to claim 1, characterized in that all of the nozzles of the dispensing machine emerge in the at least one second closed chamber.

3. A device according to claim 1, characterized in that the isolating element is made of absorbent material.

4. A device for moistening a set of nozzles for dispensing fluids from a dispensing machine, comprising:

means for supporting the nozzles, and a hollow member movable selectively along a predetermined path from a first position in which the set of nozzles is covered to a second position in which the nozzles are uncovered, characterized in that the device comprises an isolation element coupled to the hollow member and movable relative thereto from a retracted position, in which the isolation element is at least partially housed in the cavity of the hollow member, to an extracted position in which the isolation element cooperates with the support means of the nozzles to define at least one closed chamber.

5. A moistening device according to claim 4, characterized in that it comprises actuator means for bringing about the movement of the isolation element in dependence on the position adopted by the hollow member along the predetermined path.

6. A moistening device according to claim 4, characterized in that the hollow member comprises slide means slidable substantially horizontally on guide means.

7. A moistening device according to claim 5, characterized in that the actuator means comprise a guide rod for the isolation element and lever means articulated to the rod by means of a transverse pin.

8. A device according to claim 7, characterized in that it comprises resilient reaction means coupled to the rod in order to urge the isolation element to the retracted position.

9. A device according to claim 4, characterized in that the isolation element comprises an absorbent member mounted on a perforated plate for assisting a moistening liquid or solvent held in a cavity of the hollow member to pass towards the absorbent member in the retracted position.

10. A device according to claim 4, characterized in that the nozzle-support means comprise a nozzle-center body having a base and a side wall the height of which is greater than the distance by which the nozzles project from the base.

11. A device according to claim 4, characterized in that the nozzle-support means comprise a body from the base of which the nozzles emerge flush with the base, and in that the isolation element is cup-shaped with its cavity facing towards the base.

12. A device according to claim 11, characterized in that the isolation element has a resilient or flexible upper edge which can form a seal against the base of the support body.

13. A device according to claim 1, characterized in that the nozzle-support means comprise a body from the base of which the nozzles emerge flush with the base, and in that the isolation element has a series of recesses to be located in the region of the nozzles in the covering position to form a series of small chambers.

14. A machine for dispensing fluid products such as dyes, pigments, inks and the like, characterized in that it comprises a set of nozzles and a device for moistening the set of nozzles according to claim 1.

* * * * *